United States Patent [19]

Dugan

[11] 4,203,857

[45] May 20, 1980

[54] DETERGENT-SCRUBBER ARTICLE AND METHOD FOR MANUFACTURE

[75] Inventor: Bernard B. Dugan, Sandton, South Africa

[73] Assignee: Colgate-Palmolive Company, New York, N.Y.

[21] Appl. No.: 867,243

[22] Filed: Jan. 6, 1978

[51] Int. Cl.[2] ..... C11D 9/00; C11D 17/04

[52] U.S. Cl. ..... 252/92; 15/104.93; 15/104.94; 252/91; 252/108; 252/134; 252/174

[58] Field of Search ..... 252/91, 92, 134; 15/104.93, 104.94

[56] References Cited

U.S. PATENT DOCUMENTS

| | | | |
|---|---|---|---|
| 3,076,298 | 2/1963 | Tundermann | 53/4 |
| 3,148,404 | 9/1964 | Jensen | 15/104.93 |
| 3,293,684 | 12/1966 | Tundermann | 16/104.93 |
| 3,611,468 | 10/1971 | Michael | 15/104.93 |

FOREIGN PATENT DOCUMENTS

| | | |
|---|---|---|
| 661109 | 1/1965 | Belgium . |
| 1061534 | 11/1953 | France . |
| 1359106 | 3/1964 | France . |
| 512289 | 8/1939 | United Kingdom . |

*Primary Examiner*—P. E. Willis, Jr.

*Attorney, Agent, or Firm*—Herbert S. Sylvester; Murray M. Grill; Raymond F. Kramer

[57] ABSTRACT

A detergent-scrubber article includes a solid detergent composition body, preferably of flat rectangular parallelepiped shape, affixed to a relatively rigid, yet somewhat yielding body of a light weight material, such as closed cell polystyrene or polyethylene foam. The closed cell polymeric foam is also preferably of flat rectangular parallelepiped shape, with a major surface thereof affixed to the solid detergent composition body, and serves as a scrubbing, abrading or wiping article to help remove soils or stains from surfaces of items to be cleaned, such as soiled laundry, after application of the detergent composition to such surfaces. It also functions as a handle by means of which the body of detergent composition may be held without touching it while applying such detergent to items to be cleaned. Also within the invention is a method for the manufacture of the described articles wherein the major component materials are co-extruded or continuously produced, joined together, cut to desired shape and packaged.

22 Claims, 4 Drawing Figures

DETERGENT-SCRUBBER ARTICLE AND METHOD FOR MANUFACTURE

This invention relates to a detergent-scrubber article in which the scrubber portion also functions as a handle to assist in application of the detergent to surfaces to be cleaned. More particularly the invention relates to such an article made from a solid detergent composition body affixed to a relatively rigid similarly shaped material, such as a closed cell polystyrene or polyethylene foam, which foam serves as both a scrubbing body and a handle.

Amost from time immemorial man has utilized detergent materials in the washing of laundry. Until comparatively recently the detergents were essentially limited to water soluble higher fatty acid soaps, such as those made from animal and vegetable fats and oils, saponified with strongly basic materials, such as caustic soda. However, such soaps react with hardness ions in hard waters and are converted to calcium and magnesium soaps, which form objectionable gels and scum. Removal of the soluble soap by such reactions also diminishes the cleaning power of the bar being employed. Builder and filler salts have been utilized with soaps, as in heavy duty soap powders to increase detersive activity in hard water applications and such builders and fillers have also been employed with synthetic organic detergents and have been found to improve detergency (although formation of insoluble curd by reaction with calcium ion in hard water is not usually a problem when synthetic detergents are employed). Synthetic detergent bars have been manufactured wherein filler salts were included and such bars have been especially useful for sea water washing. More recently, laundry bars based on synthetic organic detergents and formulated with builder salts and fillers (or mild abrasives) have been manufactured. Because synthetic organic detergents are usually somewhat more soluble than water soluble higher fatty acid soaps laundry bars based on such detergents may dissolve too quickly and may become objectionably soft during use and after use, if then still in contact with water. When built synthetic organic detergent bars are held by hand for application of the detergent composition thereof to soiled or stained surfaces of laundry, they can be drying to the skin in some cases and sometimes may be irritating to it, often due to their builder salt contents thereof. Additionally, when comparatively thin bars are utilized or when they are reduced by solubilization to thin sections or slivers during the rubbing of laundry with the detergent bars they may easily crack and separate, which can result in losses of broken-away portions of the bar or which may require pressing together of such portions to make smaller surface area bars of lesser utility.

The laundry detergent-scrubber article of the present invention, wherein the scrubber portion also acts as a handle, allows the use of detergent bars without requiring the user to physically contact the detergent material itself, facilitates holding of the detergent composition body by means of the handle to assist in applying detergent to surfaces to be cleaned, furnishes a backing for the detergent to limit tensile strains being placed on it, which could otherwise result in disintegration of the solid detergent composition body, furnishes a platform on which the detergent composition body may be stored after use, which platform facilitates draining of water from the detergent and thereby prevents excessive gel formation, conserving the product, and helps one to hold onto and apply detergent from a relatively thin or small detergent body. Additionally, the handle portion of the invented articles serves as a scrubbing means (which term includes mildly abrading and wiping means) for working the detergent into or promoting contact of it with the surface to be cleaned and for removing loosened soils and stains from such surface. Because the scrubbing means is made of light weight material it decreases the overall density of the invented article and normally makes it capable of floating in water, thereby preventing accidental permanent or temporary loss of the article in a body of water with which it is being employed. Such feature of the present invention allows the making of the usually comparatively high density built detergent bars into products of weights and densities more normally employed by a consumer. This factor, with the handle feature, makes the present detersive articles much easier to utilize. When a binder is employed between the scrubber-handle body portion and the detergent composition body portion and when the scrubber-handle portion is made of closed cell synthetic organic polymeric foam such foam prevents the transmission of moisture through the scrubber-handle to the binding or bonding agent and thereby improves its stability and bonding effect. Thus, there is no need for the employment of protective films of water insoluble material between the foam and the binding agent nor is it necessary to utilize a binder which is so insoluble in water as to leave an objectionable residue along the contacting surface of the scrubber portion of the article as detergent is consumed and such surface is exposed.

The various advantages of the present invention described above represent significant advances in this art and lead to the accomplishment of numerous desirable objectives which relate to improving cleaning operations by means of the use of detergent bars based on synthetic organic detergents. In accordance with the present invention a detergent-scrubber article having a handle to facilitate application of detergent to items to be cleaned comprises a solid body of detergent composition selected from the group consisting of synthetic organic detergents and soaps and mixtures thereof affixed to a substantially rigid body of light weight closed cell synthetic organic polymeric foam material which is functional as a scrubbing means for scrubbing soiled or stained surfaces of items to be cleaned after application of the detergent composition to such items and which is functional as a handle by means of which the body of solid detergent composition may be held while applying such composition to the items to be cleaned. Also within the invention is a method for the manufacture of such articles.

Prior art references indicate that the manufacture of combination detergent-sponge bars has been carried out previously. Thus, among the patents relevant to such subject are U.S. Pat. Nos. 821,245; 3,076,298; 3,148,404; 3,283,357; 3,293,684; 3,359,206; and French Pat. No. 1,061,534. However, the subjects of such patents are distinguishable from the present invention, which is considered to be novel and unobvious from them, either singly or in any of various combinations. U.S. Pat. No. 821,245 relates to a combination sponge and soap cake and is intended primarily for use as a shaving stick. The sponge portion is evidently an open cell sponge and does not function as a handle. U.S. Pat. No. 3,076,298, assigned to the assignee company of the present application, relates to a combination detergent-sponge bar wherein the sponge is resilient and of open cell material. U.S. Pat. No. 3,148,404 relates to scouring pads and teaches the employment of a flexible, resilient, porous, foamed material having interconnecting pores, which includes a water resistant coating incorporating a metal powder as a scouring and polishing agent and over such coating a coating of cleaning agent. U.S. Pat. No. 3,283,357 describes a resilient synthetic foam of closed cell structure, such as one made of polyurethane (possibly crushed because the patent teaches that it is porous) coated or impregnated with a quaternary ammonium compound germicide and an amphoteric or nonionic detergent. U.S. Pat. No. 3,293,684 teaches the manufacture of a combination of a detergent cake and an open cell sponge, joined together by means of an impermeable membrane having a water insoluble adhesive on both sides thereof. U.S. Pat. No. 3,359,206 describes the employment of expanded polystyrene, normally considered as being of closed cell structure, distributed in discrete particles throughout a body of water soluble soap or being wrapped around such soap bar as a band. Finally, French Pat. No. 1,061,534 describes the use of a closed cell foam plastic such as polystyrene, in the form of discs or inserted bodies of medium thickness, joined to the surface of a piece of soap with a suitable water insoluble glue or adhesive.

The present invention distinguishes over the prior art recited above, which is the closest prior art known to applicant, in most cases because the foamed polymeric material presently employed is a closed cell material of sufficient rigidity and size to serve as a satisfactory handle and scrubbing implement for the product (so that one may rub the detergent against a surface to be cleaned without touching the detergent with the fingers or hand). Also, the present detergent compositions are built or filled normally solid anionic or nonionic detergents, not cationic germicides, and are preferably milled and plodded or pressed materials, not soft and too readily soluble pastes. Furthermore, the manufacturing method described herein is not suggested in any of the references.

The invention will be readily understood from the accompanying description thereof herein, taken in conjunction with the drawing, in which.

Figure 1:
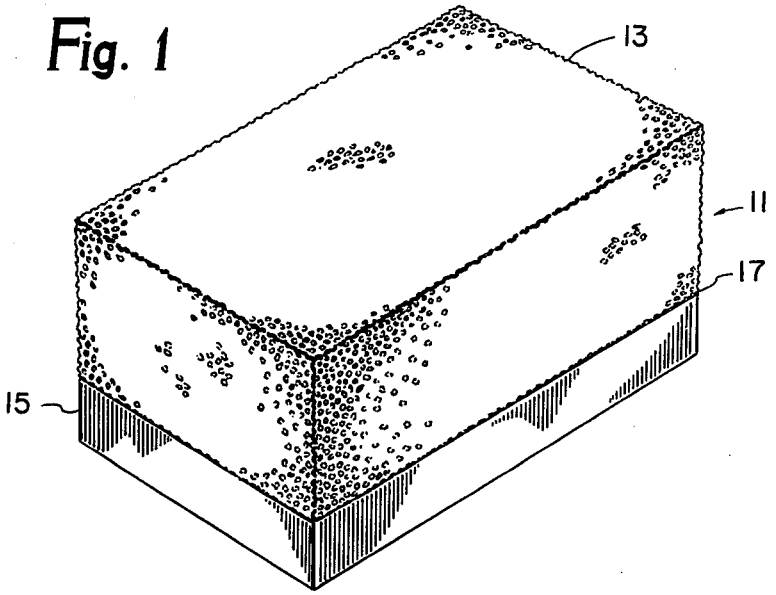
FIG. 1 is a perspective view of a preferred embodiment of an article of this invention, in flat rectangular shape, with a handle-scrubber portion of closed cell foam polymer cemented to a similarly sized but thinner bar of milled and plodded built laundry detergent.
Figure 2:
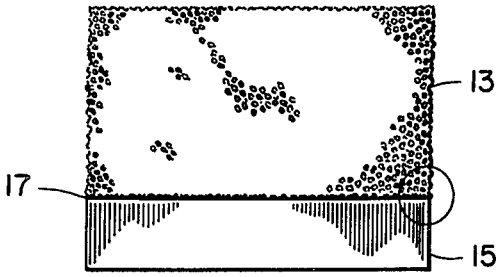
FIG. 2 is a side elevation of the bar of FIG. 1.

In FIGS. 1 and 2 the detergent-scrubber article 11 includes a scrubbing and handle portion 13 and a detergent composition portion 15 held together by cement, glue or adhesive layer 17 between major surfaces of the portions mentioned. The scrubber-handle portion 13 is of a closed cell polymeric plastic foam (a polyethylene foam is illustrated but a polystyrene or other acceptable closed cell foam can also be used). As is illustrated, the foam has been cut at the surfaces thereof or at least at some of such surfaces so that many cells at such surface are cut through or open. The structure of such cells is better shown in FIG. 3.

Figure 3:
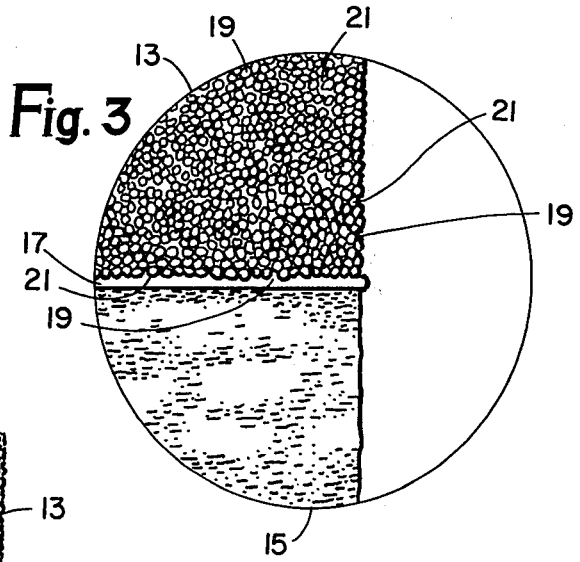
FIG. 3 is an enlarged view of the circled portion of FIG. 2.

In FIG. 3 opened cells of the polymeric foam are shown at 19 and the unaltered closed cells are shown at 21. As is seen, cement or glue 17 penetrates into the interiors of the cut surface cells to hold to the foam better. Similarly, if desired, the surface of the detergent bar to be cemented to the polymer foam may be roughened, grooved, perforated or otherwise treated to promote fastening to the foam material.

Figure 4:
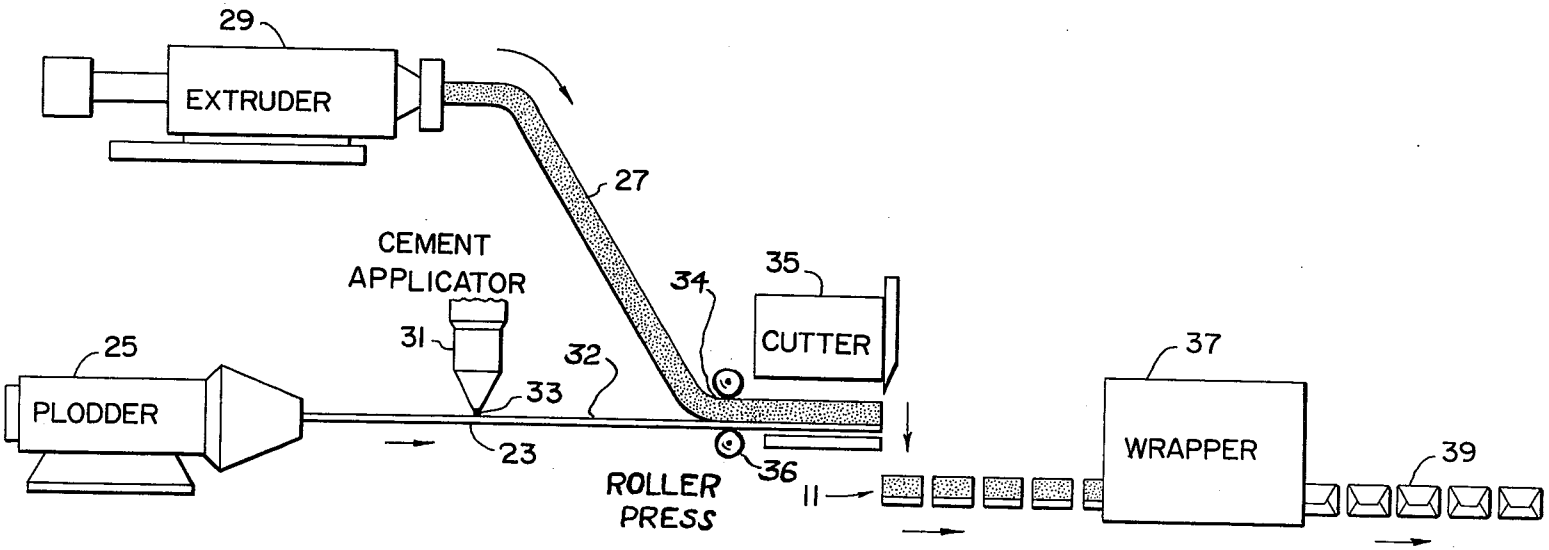
FIG. 4 is a somewhat schematic representation of the arrangement of equipment and the processing steps employed in the manufacture of the articles of FIG. 1.

In FIG. 4 a method for manufacturing a preferred article of this invention is illustrated. A milled detergent composition is plodded to continuous bar form 23 in plodder 25 and a polymeric closed cell foam is produced in bar form 27 by extruder 29. The detergent bar and the extruded foam are brought together, preferably after application by applicator 31 of intermediate cement or adhesive 33 to the major surfaces to be held together to make a coated bar 32. A roller press 36 presses the foam and handle together at a location 34 where the foam has become substantially rigid. The joined bodies, with the parts thereof not yet firmly fastened together, are cut to length at cutter 35 to form the desired articles and are wrapped at wrapping machine 37 to make the wrapped products 39, with the wrappings holding tightly to the articles and pressing the foam and detergent sections together, facilitating good cementing while the cement is hardening and while the article components are being held in good contact with each other.

The detergent compositions utilized very preferably include a synthetic organic detergent or a mixture of synthetic organic detergents as the active detersive component but the higher fatty acid soaps may also be utilized, either as such component or in mixture with synthetic organic detergent(s). Cationic detergents are generally unsatisfactory as components of the present detergent compositions and their use will be avoided. Usually they do not have the desired cleaning powers nor do they possess other desirable physical characteristics of the preferred normally solid anionic and nonionic detergents. While amphoteric detergents may be employed, preferably in combination with normally solid nonionic detergents, these too are generally less acceptable than the anionic and nonionic detergents. Soaps are useful but they do have the disadvantage of forming insoluble curd in hard waters and this is often highly objectionable. Also, they may not clean as well as the anionic and nonionic synthetic organic detergents in hard water, in which case use thereof is less preferable than that of the mentioned synthetic organic detergents.

Among the useful anionic synthetic organic detergents there may be mentioned the alkyl aryl sulfonates, preferably those wherein the alkyl group is linear and the aryl is benzene; olefin sulfonates; paraffin sulfonates; fatty alcohol sulfates; fatty acid monoglyceride sulfates; sulfated oxyethylated fatty alcohols; higher fatty esters of isethionic acid; higher fatty amides of taurine and N-methyl taurine; higher fatty amides of sarcosine; higher fatty sulfoacetates; and sulfated higher fatty alkylolamides. Additionally useful are various sulfated derivatives of nonionic detergents, such as those which will be mentioned below. In addition to the sulfonates and sulfates (the so-called sulfuric reaction products) one may also employ phosphates and phosphonates and other suitable anionic groups in making the present detergents. The alkyl and acyl groups of the anionic detergents are higher alkyls and acyls, usually being of 8 to 20 carbon atoms, preferably of 12 to 18 carbon atoms and generally preferably being linear in configuration. All the anionic synthetic organic detergents are employed as their water soluble salts, preferably as alkali metal salts and most preferably as sodium salts. However, alkaline earth metal salts, ammonium salts, triethanolamine salts and other salts than those of sodium and potassium may also be employed but the sodium salts are usually preferred because of their desirable level of water solubility and their sufficient physical hardness to be converted to a satisfactory bar product. The higher fatty acid soaps that are useful are the water soluble and normally solid soaps. Such soaps are normally of 8 to 20 carbon atoms and are obtained by saponification of usual soap making fats and oils, such as tallow, hydrogenated tallow, lard, grease, coconut oil, palm oil, palm kernel oil and other well-known materials of similar types. The soaps are usually alkali metal soaps, preferably sodium soaps, but potassium soaps have also been found satisfactory in some applications. Triethanolamine soaps or soaps of other organic bases can be used but are not usually as efficient as those of sodium. Alkaline earth metal soaps and magnesium soaps are not generally employed as higher fatty soaps but in some instances they may be added to the bar composition as fillers, or lubricants or for other purposes and sometimes magnesium slats may be added to form magnesium detergents from the synthetic anionic detergents.

The normally solid water soluble nonionic detergents that may be included in the detergent bar usually contain chains of lower alkylene oxide, most frequently ethylene oxide, to increase their hydrophilic properties. Included in this group are the higher fatty alcohol ethers of polyoxyethylene alcohols; ethylene oxide-propylene oxide block copolymers of higher molecular weight, e.g., 5,000 to 20,000; ethylene oxide aducts of lower di-alkyl phenols; higher fatty acid esters of polyoxyethylene alcohols; and higher fatty acid esters of multi-hydroxy compounds, such as sugars, hexitans, polyglycols, etc. The molecular weights of such materials will be chosen so as to result in their being of satisfactory water solubility and of sufficient hardness to be useful in the present compositions. Thus, a preferred group of such compounds includes the higher fatty condensation products which are the monoethers of a higher fatty alcohol or a mixture of such alcohols and terminally bi-alcoholic polyethylene oxide wherein the higher fatty alcohol is of 12 to 15 carbon atoms and the number of ethylene oxide units per mol is from 5 to 20, preferably 7 to 15 and most preferably 12 to 15. Although it is important that the synthetic organic detergent be sufficiently solid so as to allow the production of a satisfactory solid bar product, a relatively small proportion of a normally liquid synthetic organic detergent, usually a nonionic detergent, may be employed in the present compositions, providing that it is sufficiently absorbed or held to the other components of the composition, such as the detergents, builders, fillers and other solid components present. Thus, up to as much as 10% of a normally liquid detergent component may be present but usually such percentage will be less than 5% and most preferably is less than 2%.

Specific examples of preferred synthetic organic detergents that are anionic include sodium linear tridecyl benzene sulfonate; sodium linear dodecyl benzene sulfonate; sodium dodecyl sulfate; sodium $C_{16-18}$ paraffin sulfonate; sodium $C_{14-15}$ olefin sulfonate; sodium polyoxyethylene ethylene sulfate wherein the oxyethylene group is of 3 to 15 ethylene oxides; and sodium N-lauroyl sarcoside. Preferred nonionic detergents include condensation products of a mixture of $C_{12}$ to $C_{15}$ fatty alcohols with ethylene oxide (with 11 mols of EtO per mol); condensation products of polypropylene glycol with ethylene oxide of molecular weight of about 10,000 (Pluronics ®, made by BASF-Wyandotte); and polyoxyethylene sorbitan and hexitan higher fatty acid esters (Tweens ®, made by Atlas Chemical Industries). Instead of the anionic detergents there may be employed an anionic hydrotrope such as a soluble benzene sulfonic acid or substituted benzene sulfonic acid alkali metal salt, e.g., sodium toluene sulfonate, sodium cumeme sulfonate. Usually such will be present if at all, in lower proportion than the anionic syndet, e.g., 2 to 20%, preferably 5 to 15%, with the proportion of hydrotropic material being limited to about 1/20 to ¼ of the synthetic detergent that is present. Among the preferred soaps are the sodium soaps of tallow and hydrogenated tallow and of mixtures of either or both of such tallows with coconut oil, palm oil or palm kernel oil, wherein, for example, the ratio of tallow to coconut oil is in the range of 90:10 to 70:30, preferably 85:15 to 80:20.

Builder salts for the detergents mentioned may be inorganic and/or organic, with the former usually being preferred. Among these are included the alkali metal phosphates, polyphosphates, borates, carbonates, silicates and bicarbonates, such as pentasodium tripolyphosphate, tetrasodium pyrophosphate, tripotassium polyphosphate, sodium carbonate, sodium silicate (usually of $Na_2O:SiO_2$ ratio in the range of 1:1.6 to 1:3, e.g., 1:2.0 and 1:2.4), borax and sodium bicarbonate. Mixtures of such materials may also be utilized. Among the organic builders for synthetic organic detergents (and also for soaps) are sodium citrate, sodium gluconate, various sequestrants, including trisodium nitrilotriacetate and tetrasodium ethylene diamine tetraacetate, and trisodium 2-oxa-1,1,3-propane tricarboxylate. In addition to the water soluble builders, many of which hydrate so as to tie up moisture and thereby prevent access of such moisture to the bonding surface between the detergent composition body and the cellular polymeric foam material, also useful are the water insoluble builders of the molecular sieve or synthetic zeolite type, such as types 4A and 3A molecular sieves and various other such sieves, e.g., type X and Y sieves. Such materials are sodium aluminum silicates, usually hydrated, and also are capable of absorbing large quantities of moisture without liquefying. These and various others of these compounds that are useful are described in the text *Zeolite Molecular Sieves,* by Donald W. Breck, published in 1973 by John Wiley & Co., Inc., New York. Such zeolites may also function as mild abrasives or scrubbing components in the detergent bar.

Filler materials may also be utilized in the present detergent compositions to improve the body thereof and very often these (and other component) materials also perform other desirable functions. Among the desirable fillers are the hydratable sodium sulfates, including sodium bisulfate. Sodium chloride may also be employed but is not a sorbent for moisture. Clays, wood flour, finely divided silica (silex), pumice powder and similar materials may perform a filler function but usually will be primarily considered as abrasives or scrubbing agents, intended to improve rubbing contact with the article to be cleaned. The particle sizes of such materials and others employed in the present bars will usually be kept small enough so as not to be destructive of or harmful to the materials being cleaned, when being used. Thus, in scrubber bars of the type presently described, which are intended for use in washing laundry, particularly in helping to remove dirt from shirt collars and cuffs, the particle sizes will be less than one millimeter, preferably less than 500 microns and most preferably less than 100 microns. Similarly, with respect to other insoluble materials which may be present in the compositions limitations to such particle sizes will also be desirable. Normally the particles will be larger than five microns and generally most of them will be larger than ten microns, equivalent diameters.

In addition to the previously mentioned desirable components of the present bars there may also be present in such bars small proportions of water and various adjuvants. The proportion of water will usually be 1 to 20%, preferably 3 to 15% and often most preferably 5 to 10%. The total amount of adjuvants will generally not exceed 20% and preferably will not exceed 10% of the bar, often being less than 5% thereof. Amounts of individual adjuvants are usually small, e.g., 0.05 to 8% and preferably 0.05 to 2%. The adjuvants which may be employed include inorganic pigments, such as titanium dioxide and ultramarine blue; organic pigments, e.g., Indanthrene Blue RS; dyes, e.g., Color Index Direct Blue 1; fluorescent dyes, known as optical brighteners, such as coumarin, triazolyl stilbene, stilbene cyanuric, acylamino stilbene and other types; organic gum antiredeposition agents, e.g., sodium carboxymethyl cellulose, polyvinyl alcohol, polyvinyl pyrrolidone, polyacrylamide; perfumes; fungicides or preservatives, e.g., polyhalosalicylanides; sanitizers, e.g., trichlorocarbanilide; foam supressors, e.g., N,N-dilauryl amine; enzymes, e.g., subtilisin protease; bleaching agents, e.g., di- and tri- chloro (or bromo) cyanuric acid and water soluble salts thereof and sodium perborate; fabric softeners, e.g., 1,2-alkane diols of 15–18 carbon atoms; plasticizers, e.g., cetyl alcohol, glycerine, propylene glycol; and bodying agents, e.g., wood flour.

The proportions of the various components of the detergent bar composition will normally be in the range of 5 to 35% of water soluble detergent component, 20 to 95% of builder and 0 to 60% of filler. If water is present the proportion thereof will usually be in the range of 1 or 2 to 20 or 25% (including water of hydration). The proportions of adjuvants will generally be limited to 20%, as previously mentioned. Preferably, the detergent will be water soluble synthetic anionic organic detergent, the builder will be water soluble inorganic builder salt and the filler will be water soluble filler salt, sometimes in conjunction with a water insoluble inorganic powder material, which may function as a scrubbing agent to improve cleaning power of the product. The ranges of water soluble filler salt and water insoluble inorganic powder will usually be 0 to 60% of the former and 0 to 50% of the latter, preferably 5 to 40% of filler, when employed, and 10 to 35% of abrasive or scrubbing agent, when employed.

Although it is possible to utilize a settable detergent composition which is deposited on the surface of the foamed polymeric material and allowed to harden and set there to produce an article resembling that shown in FIGS. 1–3, in which setting will preferably be promoted by hydration of the content of hydratable builder or filler present, it is highly preferred to utilize a plodded detergent composition in bar form, the manufacture of which is illustrated in FIG. 4. For the manufacture of such a bar the various components of the composition are mixed together and the mix is plodded, utilizing a conventional soap or detergent plodder, which compresses the mix and converts it to form retaining bar shape. Preferably, before plodding the mixture is amalgamated so that the components thereof are evenly distributed, and then is milled, using a soap mill, preferably of 3 or 5 rolls or more, to even better disperse the various components. Mill opening settings may vary but for best mixing and size reduction of oversize particles they are usually in the range of 0.1 mm. to 0.4 mm., preferably 0.1 to 0.3 mm. If desired, before milling and plodding, the moisture and volatile materials content of the detergent composition may be decreased by a drying operation, such as one wherein chips or flakes of the composition are made and are dried on a belt dryer by means of warm air.

The handle-scrubber portion of the invented articles is one which is relatively rigid and of light weight, in addition to being of a thickness greater than that of the solid detergent composition body. While various materials may be employed for the handle-scrubber, an important consideration is that the material selected should be sufficiently rigid, so that even when wet it will not become so pliable as to make it unsuited for holding and for use as a scrubbing surface. Thus, opened cell foams such as cellulosic foams and open celled polyurethane foams are not useful to make the articles of the present invention. Some essentially closed cell materials, such as light weight woods, e.g., balsa wood, which satisfy the density requirements of the present invention, may be employed but far superior to any such other materials are the closed cell synthetic organic polymeric material foams, such as those of polystyrene or polyethylene. Other such foams may also be used, including those made from polypropylene and polyurethane and various other foamed plastics, providing they have the desired characteristics of low density, water insolubility, relative rigidity (resistance to excessive distortion) and surface and cell strength to make them suitable for employment as scrubbing surfaces. Thus, among such materials from which suitable foams can often be made are acrylics, cellulose acetates, epoxies, polybenzimidazoles, polycarbonates, polyethylenes (both cross-linked and non-cross-linked), ionomers, phenolics, polypropylenes (preferably cross-linked), polystyrenes, polyurethanes, polyvinyl chlorides, silicones, styrene acrylonitriles and urea formaldehydes. Additionally, various reinforced foams may be employed, such as those of nylons, polycarbonates, polypropylenes and polystyrenes (but preferably these are of lower densities than those normally utilized for such reinforced foams).

The closed cell polymer foams employed will preferably be extrudable to quickly solidifable form, such as by the apparatus and method illustrated in FIG. 4. However, such foams may be cast in place or may be made into rods, slabs or bars which are subsequently cut to desired shape. Also, they may be molded to shapes, in which case it is easier to form rounded corners, curved surfaces and various other shapes and indicia. The synthetic organic polymeric foam will normally be of a density in the range of 0.01 to 0.7 g./cc., preferably from 0.01 to 0.2 g./cc. and more preferably from 0.01 to 0.07 g./cc., most preferably being 0.01 to 0.04 g./cc. for polystyrene and 0.02 to 0.07 g./cc. for polyethylene and similar materials. The compression strength of the foam at a 10% deflection, as measured by ASTM Test D 1621, will usually be in the range of 0.1 to 20 kg./sq. cm.

and preferably will be 0.1 to 10 kg./sq. cm., most preferably being about 0.2 to 2 kg./sq. cm. Compressive strengths in such ranges allow the successful utilization of the foam as a scrubbing implement and furnish sufficient rigidity so that it may be employed as a handle. Thus, while holding the foam handle at the sides thereof with a force of about 5 kg. exerted by the thumb on one side and the four fingers on the other side at room temperature (20° C.), a suitable polyethylene or polystyrene foam will deflect about 0.5 to 5 mm. and is resilient enough to return to the original form when the pressure is released. Tensile strengths should be greater than 1 kg./sq. cm., preferably being from 1 to 10 kg./sq. cm., so as to avoid fragmenting of the product during subjection of it to the strains of ordinary scrubbing and handle uses.

Of the various foams that are usable, polystyrene and polyethylene foams are most preferred. The former foam is inexpensive, the various cells are filled with polystyrene material and it acts satisfactorily as a handle and scrubbing material. However, polyethylene foams often appear to be easier to hold, have surfaces of more desirable tactile properties and often are of more attractive appearance, especially after use. They also appear to be more resistant to separations of minor portions of cells, which appear to be more firmly interconnected than those of polystyrene.

To fasten the milled and plodded detergent bar and extruded closed cell plastic body together the employment of cement, glue or adhesive is not always necessary. Thus, when the closed cell foam is still somewhat soft, either before total curing or before cooling to rigidity, pressing a surface thereof against the detergent bar, especially if such bar is extruded in striated or grooved shape on the joining major surface or has perforations made at such surface, can result in the two portions of the invented article being satisfactorily held together so as to resist any strains which might tend to separate them during normal use. Also, the detergent may be solidified, as by hydration of hydratable salts thereof, while in contact with a surface of the cellular foam and especially if such surface has been cut or roughened beforehand, the detergent composition, filling such openings, may make a firm bond. However, often it will be more desirable to utilize an appropriate cement, glue or adhesive, which may preferably be a synthetic or organic resinous material, such as polyvinyl acetate, epoxy resin, melamine formaldehyde, phenolic resin, urea formaldehyde, nylon, cyanoacrylate, silicone elastomer, polyethylene, polyvinyl butyral, polyisobutylene, polyisoprene, neoprene or nitrile rubber. However other bonding agents may also be used, such as casein, hide and bone glues and other protein based glues, and any other suitable materials known to be effective cements, etc., e.g., silicate cements. Alternatively, a solvent may be employed to soften the plastic of the foam polymer so that such surface itself may be bonded to the detergent bar. Generally, it will be desirable for the bonding agent employed to hold tightly to both the detergent and the foam polymer and resist loosening when contacted by water, yet not leave an objectionable surface in contact with the foam at locations where the detergent has been dissolved away. It appears that polyvinyl acetate and casein glues are inexpensive products which satisfactorily and effectively function as the desired binding agents and have the described desirable properties. However, pressure sensitive rubber-based or similar adhesives are also quite useful, as are various others of the binders or bonding agents of the types mentioned above.

The ratio of the volume of the solid detergent composition body to that of the light weight synthetic polymeric material body will normally be in the range of 1:1.5 to 1:10, preferably being from 1:1.5 to 1:3 and most preferably being about 1:2 to 1:3. The thickness of the usually substantially flat detergent body will normally be from 5 mm. to 5 cm. for the foam body and 2 mm. to 2 cm. for the detergent body, and preferably from 1.5 cm. to 3.5 cm. for the foam body and 8 mm. to 1.5 cm. for the detergent composition body. At such thicknesses and volumes and in such ratios of volumes (and thicknesses) satisfactory handles and scrubbing surfaces are provided and over the density ranges of the detergent composition bodies and those of the polymeric foam the total article will float in water. Weights of the articles will usually range from 25 to 150 grams, preferably 30 to 130 g., with volumes of 75 to 250 cc., preferably 90 to 240 cc., and overall densities of 0.4 to 0.9, preferably 0.4 to 0.7.

The cement layer, when employed, will normally not be of a greater thickness than about 1 mm. and preferably, is less, e.g., 0.2 mm. Such thickness does not include penetration into the opened cells of the foam and such penetration may be equal to the cell's equivalent diameter. Of course, when no cement, glue or adhesive is utilized, in some cases the polymeric material may be fused for the top cell thickness or the fused layer may be up to about twice such thickness. Normally, the layer of adhesive or fused material will be at least 0.1 mm. thick. While it is possible to spot adhesive or distribute it in lines or other patterns across the surfaces to be joined together, normally evenly spreading over the entire surfaces, as by a doctor roll, is preferable, for best joinders.

The products of this invention possess many significant advantages over prior art products. The inventive conceptive is a new one, wherein a rigid closed cell foam acts as both a handle and a scrubbing surface and at the same time rigidifies a relatively thin detergent composition bar to prevent any cracking during shipment, storage and use. The handle may be employed to apply the soap to desired areas to be cleaned, such as shirt collars and cuffs, and then, without having to employ a scrubbing brush, the article may be turned over and still without touching the detergent bar or at most touching it only slightly, the scrubbing surface may be rubbed against the shirt collar to better apply the detergent and to remove dirt. The closed cell foam, which is essentially hydrophobic, prevents water from loosening the bond between it and the detergent composition body, so that even water soluble adhesives may often be satisfactorily employed. The product floats so that when being employed in deep wash tubs or in running water, where heavier bars may be lost, the present article is easily retrived if it slips out of the grasp of the user. Because of its light weight and the easy gripping feature of the handle thereof there is also less danger of having the article dropped during use. The invented product is capable of being used for a single washing, as of about 2 to 3 kg. of laundry, or it may be partially consumed working on one load of laundry and saved, dried out with the support surface downward, to facilitate draining of the detergent and to prevent formation of objectionable gel, and used again. At the end of use of the product, after consuming of the last part of the detergent bar portion, the material left may be employed independently as a scrubbing implement. Alternatively, it may be recombined with another detergent body, may be employed as a toy (building blocks), a plaque (for painting) or as material for making sculptures. Although the preferred shape is a rectangular parallelepiped, usually with the length being from 1 to 2 times the width and from 2 to 4 times the thickness, the length and width may be equal and this may sometimes be more desirable for ease of grasping of the product by small hands. Instead of using regular parallelepipeds such articles may be shaped irregularly and may be curved or indented to better fit the hands or to make the foamed portions thereof more readily useful after consumption of the detergent.

The following examples illustrate but do not limit the invention. Unless otherwise indicated all parts are by weight and all temperatures are in °C. therein and throughout this specification and the appended claims.

EXAMPLE 1

A dodecylbenzene sulfonic acid of light color, having been bleached with hydrogen peroxide, is mixed with water, sodium carbonate, kaolin, impalpable calcium carbonate, titanium dioxide, magnesium sulfate, perfume and sufficient moisture to approximately compensate for that expected to be lost in processing. The mix formula follows:

| | Parts |
|---|---|
| *Bleached dodecylbenzene sulfonic acid | 24.8 |
| Sodium carbonate, dense | 36.8 |
| Kaolin | 12.0 |
| Calcium carbonate, impalpable | 22.1 |
| Titanium dioxide, rutile | 0.3 |
| Magnesium sulfate | 2.0 |
| Perfume (citronellal) | 0.3 |
| Water | 1.7 |
| | 100.0 |

*85% dodecylbenzene sulfonic acid, 2% sulfuric acid, 3.2% free organic acid and 9.8% water.

In the above product the sizes of particulate materials utilized are in the five micron to one millimeter equivalent diameter range, mostly being between 0.1 mm. and 1 mm. in equivalent diameter. After mixing in a sigma blade mixer is completed the detergent composition resulting is milled in a three-roll soap mill, set at an opening in the 0.1 mm. to 0.3 mm. range and is continuously plodded as a flat bar having a thickness of 1.1 cm. and a width of 5.9 cm. During manufacture of the bar there is a moisture loss of about 1.6 parts so that 98.4 parts of detergent composition bar product result. Such bar contains 22.8% of sodium dodecylbenzene sulfonate, 30.7% of sodium carbonate, 5.0% of sodium bicarbonate, plus the calculatable proportions of the other components. The continuous bar is cut to rectangular shaped pieces, with the length thereof being 9.2 cm.

A closed cell polyethylene foam, Ethafoam 220, made by The Dow Chemical Company, having closed cells of equivalent diameters of about 0.5 mm to 2 mm., most of which are of diameters in the 0.8 to 1.5 mm. range, and having a density of about 0.035 g./cc., is cut to size to match the length and width of the detergent composition body, with a thickness of 3.2 cm. A major surface of such body has had cells thereof cut or otherwise divided so that the opened cells at such surface may serve as anchors for a bonding agent. Thin layers (e.g., 0.2 mm. thick) of polyvinyl acetate resin glue (Elmer's Glue-All, mfd. by Borden Chemical Co.) are spread on the major surfaces of both the detergent composition body and the foam body, and such surfaces are pressed together with a nominal force, e.g., 0.3 kg./sq. cm., until sealed. In one aspect of the invention the combination article, after application of the cement and pressing of the parts together, is packaged and the packaging holds the article together until the cement or other bonding agent is set. In still another embodiment of the invention holding means, such as rubber bands, are utilized to hold the parts of the article together during setting of the cement or glue and if desired, may be retained thereon to assist in such holding during use. However, although such additional holding means are useful, they are not necessary.

The detergent scrubber made is tested for use in washing clothing, such as heavily soiled shirts and trousers, some of which are oily and greasy denims, also having clay and dirt thereon. Application of detergent composition by contacting the soiled surfaces with the detergent body portion of the bar while holding the article by the handle, and subsequent application of the foam surface to that spot with a rubbing motion significantly facilitate removal of the oil, grease, clay and dirt and other staining materials also present. Similarly, shirt cuffs and collars are treated and it is found that dirt thereon is readily and conveniently removed. The detergent-scrubber article floats in wash water so it is not readily lost and does not require immersing of one's arm in a tub or dishpan to retrieve such an article that has slipped from one's hand. Also, because of its lighter weight and effective handle portion it is easier to hold so that dropping it is a less frequent occurrence. When use of the bar is temporarily halted it is stored with the foam side down and it is found that it drains and rehardens faster, without the formation of objectionable gel on the bar and on the sink and other surfaces on which it is placed. Despite repeated uses the detergent composition body portion is satisfactorily held to the closed cell foam portion and even if it is accidentally removed therefrom it is still possible to reassemble the parts readily, utilizing cement, as originally applied, or using mechanical means for refastening. During continued use, wherein several loads of laundry, up to ten kg., are washed with the invented product, the detergent composition body wears down evenly and does not crack or disintegrate into smaller pieces; and thus the present article helps to conserve detergent. For any composition that might dry poorly, single use tablets may be preferred.

Test results indicate that the invented product is superior to ordinary laundry detergent bars in removing dirt, in economy, in being kind to the hands, in not causing fading of clothing, for washing rough fabrics, such as denim, for washing delicate fabrics, for removing dirt with minimum scrubbing effort, for being capable of scrubbing a larger area, for being easy to rinse, for being easy to rub on clothes and for remaining dry and hard when not used. It was also found to be capable of many other uses than just for washing heavily soiled laundry. Such greater acceptance of the present product, compared to prior art products available, indicates the significance of the advance made by this invention.

When the detergent composition is completely consumed the cellular foam body is still of approximately its original size and shape. It may be recoated with another slab of detergent, may be used as an art material or a plaything or may be employed in various other ways for functional and aesthetic purposes.

In variations of the invention different detergent compositions may be utilized, such as those having sodium lauryl sulfate; sodium tridecylbenzene sulfonate; sodium dodecylbenzene sulfonate plus 1/10 such proportion of nonionic detergent (Neodol 45-11, mfd. by Shell Chemical Co.); and a mixture of sodium soaps of hydrogenated tallow and hydrogenated coconut oil (85:15 weight proportion) and sodium tridecylbenzene sulfonate (in 50:50 proportion) replacing the sodium dodecylbenzene sulfonate; pentasodium tripolyphosphate or equal parts of sodium carbonate and sodium silicate ($Na_2O:SiO_2=1:2.4$) replacing the sodium carbonate and sodium bicarbonate; and sodium sulfate replacing the kaolin and magnesium sulfate. Alternatively, the magnesium sulfate may be omitted from the formula and the moisture content of the finished production may be adjusted to about 9%. The products resulting will also be useful detergent-scrubber articles. Similarly, the closed cell polyethylene foam may be replaced by Styrofoam ® of similar size and structure, such as Dow Styrofoam 1B, which is also of about the same density as the polyethylene foam. Also, the polyvinyl acetate emulsion glue may be replaced with casein, epoxy, cyanoacrylate or sodium silicate solution (water glass). Such products have the physical characteristics previously mentioned in the specification and the polystyrene foam performs in similar fashion when incorporated in the invented articles. In further modifications of the product the thicknesses of the component parts are diminished to ¾ and ½ (for both parts) of the original thicknesses and further to ¼ for the detergent composition body, while retaining ½ original thickness for the foam. The different products so described are also useful in the same manner as the others heretofore mentioned with the exception that the detergent composition will be more readily consumed and so such products are more suited for fewer wash loads, some being useful for only a single washing. To increase the useful life of the product it may be employed only for rubbing difficult to remove dirt deposits and/or stains, with the major proportion of detergent composition for washing of the entire garment or laundry article being supplied by a commercial liquid or powdered heavy duty laundry detergent, which may be used in a washing machine.

In addition to employing the present product for washing laundry, it also is used for washing walls, floors, bathtubs, sinks, dishes and various other materials and surfaces and performs satisfactorily, with the advantages previously recited for it. Thus, by "scrubbing article" it is intended also to cover wiping, applying, abrading, etc. articles.

Various additional modifications in the product are possible and are advantageous. For example, the detergent body and the foam body may be colored the same, by dyes or pigments, or may be made in contrasting colors. They may be physically interfitted, as by mortise-tenon joints, to promote holding together during use. The detergent composition body may be lightened in weight by having light weight cellular polymeric material, such as expanded polystyrene beads (from which the closed cell polystyrene body may be made, although that described in this example was not so made), dispersed in the detergent composition mix before plodding (care will be taken not to crush such spheres during the milling operation). In addition to perfuming the bar the foam may be perfumed and this may allow the use of perfumes which would not otherwise be stable in the normally alkaline detergent composition medium. As was previously mentioned in the specification both the detergent composition body and the cellular foam body may be shaped as desired, for example, to elliptical, circular or square shapes, viewing the major surface, and may be rounded or have indentations therein for easier holding.

EXAMPLE 2

| | Parts |
|---|---|
| Linear dodecylbenzene sulfonic acid (85% active ingredient, 10% water, 5% impurities) | 1,000 |
| Pentasodium tripolyphosphate (slow hydrating) | 1,732 |
| Sodium hydroxide | 132 |
| Water | 400 |
| Sodium silicate (50% aqueous solution) | 600 |
| Sodium toluene sulfonate (powder) | 80 |
| Sodium carboxymethyl cellulose | 40 |
| Optical brightener | 4 |
| Blue pigment | 8 |
| Polyox WSR 301 (solid polyoxyethylene glycol) | 4 |
| | 4,000 |

The detergent composition is made of the described formula by neutralization of the sulfonic acid with the sodium hydroxide in the presence of water and subsequent combination of the reaction product and the other constituents. After completion of mixing the thick pasty product is quickly applied to a major surface of a cellular polystyrene body made from expandable polystyrene particles, which polystyrene body measures 7 cm. by 7 cm. by 2.3 cm. and weighs 2.5 grams. 32 Grams of detergent composition are placed on the described slab of expanded polystyrene (of a density of about 0.02 g./cc.) to form a layer about 0.9 cm. thick thereon. The detergent composition body is allowed to set, which occurs when the pentasodium tripolyphosphate is completely hydrated, and the product is ready for use. It has substantially the same utilities as the product of Example 1 and is found to be an excellent detersive article, which is easy to employ, and possesses the mentioned significant advantages over prior art detergent composition bars.

In variations of this example, water glass (sodium silicate solution) is applied to the polystyrene foam before contacting of it with detergent composition, and this assists in sealing the detergent and foam portions of the article together. Of course, as in Example 1, the composition of the detergent body may be varied and to secure a smoother texture it may be milled and extruded as a form-retaining paste before being applied to the foam. Instead of employing the polystyrene foam, the cells of which are about 1.5 mm. to 3 mm. in equivalent diameter, compared to 0.7 mm. to 3 mm. for polyethylene, cross-linked or non-cross-linked polyethylene and the other cellular materials previously described may be substituted. Also, by utilizing expanded polystyrene beads and/or air in the detergent composition mix, the density thereof may be changed within the 0.8 to 2.3 g./cc. range, which is preferably 1.4 to 2 g./cc., for the compositions of these examples and for the other products described in the specification. Similarly, the thicknesses of the detergent composition body and the foam body may be varied within the 1:1.5 to 1:10 thickness ratio range. Preferably, when substituting different cellular materials of the closed cell type, care will be taken so that the physical characteristics thereof previously discussed in the specification, compression strength and tensile strength, in addition to density, are within the described ranges, as are those of the present examples.

EXAMPLE 3

The products of Examples 1 and 2 are made by extruding the detergent and foam compositions thereof through a plodder and plastic extruder, respectively, applying adhesive or cement of the type described to either or both of the surfaces to be joined, joining the products together, pressing them with a roll press or other suitable device, cutting and packing. Instead of using a cutter, a hot wire may be employed and instead of applying adhesive or cement, reliance may be on the hardening of the detergent composition body portion holding it to the surface of the foam or on the foam being fused and pressed against the detergent composition body. Alternatively, other means of holding the two parts together during and/or after setting may be employed, such as mechanical fasteners, previously mentioned.

The manufacturing method described provides for quick and efficient production of the desired products automatically. It helps to conserve perfume and volatiles, which might otherwise be lost during open air setting or curing processes, which might otherwise be accompanied by drying. The products of this example also are of the same utilities as described for the products of Examples 1 and 2 and the mentioned variations thereof.

The invention has been described with respect to various illustrative and preferred embodiments thereof but is not to be limited to these because it is evident that one of skill in the art, with the present specification before him, will be able to utilize substitutes and equivalents, without departing from the spirit of the invention.

What is claimed is:

1. A detergent-scrubber article having a handle to facilitate application of detergent to items to be cleaned which comprises a solid body of detergent composition selected from the group consisting of synthetic organic detergents and soaps and mixtures thereof affixed to a substantially rigid body of light weight closed cell synthetic organic polymeric foam material which is functional as a scrubbing means for scrubbing soiled or stained surfaces of items to be cleaned after application of the detergent composition to such items and which is functional as a handle by means of which the body of solid detergent composition may be held while applying such composition to the items to be cleaned.

2. An article according to claim 1 wherein the solid detergent composition includes a material selected from the group consisting of builders, fillers and mixtures thereof and is in generally flat form, having a surface for affixation to the body of light weight material and the body of light weight material is of a thickness substantially greater than that of the body of solid detergent composition, has a surface conforming to a surface of said body and is affixed to said surface of said body.

3. A detergent-scrubber article having a handle to facilitate application of detergent to items to be cleaned which comprises a solid body of detergent composition selected from the group consisting of synthetic organic detergents and soaps and mixtures thereof affixed to a rigid body of light weight closed cell synthetic organic polymeric foam material of thickness greater than that of the solid detergent composition body so that the body of the light weight closed cell material is functional as a scrubbing means for scrubbing soiled or stained surfaces of items to be cleaned after application of the detergent composition to such items and is functional as a handle by means of which the body of solid detergent composition may be held without touching it while applying it to the items to be cleaned.

4. An article according to claim 2 wherein the solid detergent composition part thereof is a plodded detergent composition bar.

5. An article according to claim 4 wherein the solid detergent composition body and the body of closed cell foam of synthetic organic polymer are flat and are joined together at major surfaces thereof.

6. An article according to claim 5 wherein the solid detergent composition body and the body of closed cell foam of synthetic organic polymer are joined together by a binder.

7. An article according to claim 6 wherein the body of light weight closed cell foam of synthetic organic polymer is of a density in the range of 0.01 to 0.7 g./cc., the cells of the closed cell synthetic organic polymer are of sizes in the range of 0.3 mm. to 5 mm., equivalent diameter, the body of solid detergent composition is of a density in the range of 0.8 to 2.3 g./cc. and the ratio of volumes of solid detergent composition body and light weight synthetic polymeric material body is in the range of 1:1.5 to 1:10.

8. An article according to claim 7 wherein the density of the body of the light weight closed cell foam of synthetic organic polymer is in the range of 0.01 to 0.2 g./cc., the density of the body of the solid detergent composition is in the range of 1.4 to 2 g./cc., the compression strength of the foam at 10% deflection is in the range of 0.1 to 20 kg./sq. cm. and the tensile strength thereof is at least 1 kg./sq. cm.

9. An article according to claim 8 wherein the synthetic organic polymer is polystyrene.

10. An article according to claim 8 wherein the synthetic organic polymer is polyethylene.

11. An article according to claim 8 wherein the detergent composition is a built synthetic organic detergent composition comprising 5 to 35% of water soluble synthetic anionic organic detergent, 20 to 95% of water soluble inorganic builder salt, 0 to 60% of water soluble filler salt and 0 to 50% of water insoluble inorganic powder.

12. An article according to claim 11 wherein the closed cell foam is a polystyrene foam of a density in the range of 0.01 to 0.04 g./cc., the body of polystyrene foam and the body of detergent composition are flat and are held together at major surfaces thereof by a binding material, the ratio of thicknesses of the foam and detergent composition bodies is in the range of 1:1.5 to 1:3 and such thicknesses are in the ranges of 5 mm. to 5 cm. for the polystyrene foam body and 2 mm. to 2 cm. for the detergent composition body.

13. An article according to claim 12 wherein the density of the closed cell polystyrene foam is about 0.02 g./cc., the cells are of equivalent diameters in the range of 1.5 mm. to 3 mm. and the polystyrene foam body is held to the detergent composition body by a binder.

14. An article according to claim 11 wherein the closed cell foam is a polyethylene foam of a density in the range of 0.02 to 0.07 g./cc., the body of polyethylene foam and the body of detergent composition are flat and are held together at major surfaces thereof by an organic resinous binding material, the ratio of thicknesses of the foam and detergent composition bodies is in the range of 1:1.5 to 1:3 and such thicknesses are in the ranges of 5 mm. to 5 cm. for the polyethylene foam body and 2 mm. to 2 cm. for the detergent composition body.

15. An article according to claim 14 wherein the density of the closed cell polyethylene foam is about 0.03 g./cc., the cells are of equivalent diameters in the range of 0.7 mm. to 3 mm., the cells are open at the surface affixed to the body of detergent composition and such openings are filled with polyvinyl acetate binder which holds the foam body tightly to the detergent composition body before, during and after use of the article.

16. An article according to claim 1 of substantially rectangular parallelepiped shape, with the solid detergent composition body and the relatively rigid body of light weight material both being of rectangular parallelepiped shape and joined together at major surfaces thereof.

17. An article according to claim 1 wherein the relatively rigid body of light weight material is of a light weight closed cell foam of synthetic organic polymer of a density in the range of 0.01 to 0.7 g./cc. and wherein the body of solid detergent composition is of a density in the range of 0.8 to 2.3 g./cc.

18. An article according to claim 1 wherein the light weight material is closed cell polystyrene.

19. An article according to claim 1 wherein the light weight material is closed cell polyethylene.

20. A method of manufacturing a detergent-scrubber article which comprises continuously producing a bar or slab of relatively rigid light weight closed cell synthetic organic polymeric material, continuously producing a solid bar or slab of detergent composition, continuously joining major surfaces of such bars or slabs together as they are produced so that a bar or slab of light weight closed cell material is brought into contact with a bar or slab, respectively, of detergent composition, pressing such parts of the detergent-scrubber article together to affix the detergent composition to the closed cell polymer and cutting the combination product to shape.

21. A method according to claim 20 wherein the product made is a detergent-scrubber article having a handle to facilitate application of detergent to items to be cleaned, which article comprises a flat solid detergent composition body affixed to a flat, light weight body of closed cell foam of synthetic organic polymer, the polymer body functioning as a scrubbing means for scrubbing soiled or stained surfaces of items to be cleaned after application of the detergent composition to such items and functioning as a handle by means of which the solid detergent composition may be held while applying it to the items to be cleaned, the detergent composition comprising a detergent selected from the group consisting of soap and synthetic organic detergents and mixtures thereof and a material selected from the group consisting of builders, fillers and mixtures thereof and with the body of light weight material being of a thickness substantially greater than that of the solid detergent composition body and wherein prior to contacting the solid detergent composition with the closed cell foam a binder is applied to at least one of the surfaces to be brought into contact.

22. A method according to claim 21 wherein after pressing the solid detergent composition bar or slab against the closed cell synthetic organic polymeric foam bar or slab, with binder between the major surfaces thereof which are being affixed together, and after cutting of the bars or slabs to shape, such surfaces are held together by wrapping material, to facilitate permanent affixation together of the solid detergent composition body and the closed cell polymeric foam body.

* * * * *